US011773637B2

(12) United States Patent
Mareaux

(10) Patent No.: US 11,773,637 B2
(45) Date of Patent: Oct. 3, 2023

(54) SYSTEM FOR LOCKING A SCREEN DOOR LEAF

(71) Applicant: FAIVELEY TRANSPORT TOURS, Saint Pierre des Corps (FR)

(72) Inventor: Sébastien Mareaux, Tours (FR)

(73) Assignee: FAIVELEY TRANSPORT TOURS, Saint-Pierre-des-Corps (FR)

( * ) Notice: Subject to any disclaimer, the term of this patent is extended or adjusted under 35 U.S.C. 154(b) by 174 days.

(21) Appl. No.: 16/762,206

(22) PCT Filed: Nov. 29, 2018

(86) PCT No.: PCT/FR2018/053049
§ 371 (c)(1),
(2) Date: May 7, 2020

(87) PCT Pub. No.: WO2019/106310
PCT Pub. Date: Jun. 6, 2019

(65) Prior Publication Data

US 2020/0355011 A1 Nov. 12, 2020

(30) Foreign Application Priority Data

Nov. 29, 2017 (FR) ..... 1761371

(51) Int. Cl.
*E05F 15/00* (2015.01)
*E05F 15/643* (2015.01)
(Continued)

(52) U.S. Cl.
CPC ..... *E05F 15/643* (2015.01); *B61B 1/02* (2013.01); *E05D 15/0621* (2013.01); *E05Y 2900/132* (2013.01); *E05Y 2900/51* (2013.01)

(58) Field of Classification Search
CPC ..... E05F 15/643; B61B 1/02; E05D 15/0621; B60J 5/06
See application file for complete search history.

(56) References Cited

U.S. PATENT DOCUMENTS 5,077,938 A * 1/1992 Moreuil ..... E05F 15/652 74/424.89
6,282,970 B1 * 9/2001 Oakley ..... E05F 15/652 49/362
(Continued)

FOREIGN PATENT DOCUMENTS

EP 0903275 A1 * 3/1999 ..... E05F 15/652
EP 0903275 B1 * 12/2001
(Continued)

OTHER PUBLICATIONS

International Search Report for corresponding application PCT/FR2018/053049 filed Nov. 29, 2018; dated Mar. 1, 2019.

*Primary Examiner* — Daniel J Troy
*Assistant Examiner* — Daniel Alvarez
(74) *Attorney, Agent, or Firm* — The Small Patent Law Group LLC; William Breeze

(57) ABSTRACT

A system for locking a platform screen door leaf, the leaf being capable of moving by a horizontal translational movement in a plane of the leaf between open and closed positions, including a bearing rail mounted on the leaf and having a reception recess, a motor body forming the stator of a drive motor of the leaf and mounted freely in rotation about a motor axis on a gear unit, a locking roller mounted projecting on the motor body and arranged so as to roll along the bearing rail during a movement of the leaf, and engage, by a rotation of the motor body, in the reception recess when the leaf reaches the closed position or the open position, in order to lock.

18 Claims, 6 Drawing Sheets

(51) Int. Cl.
*B61B 1/02* (2006.01)
*E05D 15/06* (2006.01)

(56) References Cited

U.S. PATENT DOCUMENTS

| | | | | |
|---|---|---|---|---|
| 9,452,761 | B2 * | 9/2016 | Romero | E05D 15/0617 |
| 2006/0172034 | A1 * | 8/2006 | Laar | B29C 33/36 425/451.4 |
| 2013/0298706 | A1 * | 11/2013 | Linnenkohl | B60J 5/06 74/89 |
| 2016/0046176 | A1 * | 2/2016 | Prevost | E05F 15/646 49/506 |
| 2018/0216394 | A1 * | 8/2018 | Mareaux | E05D 15/0617 |
| 2019/0249478 | A1 * | 8/2019 | Eichler | E05C 17/60 |
| 2019/0345752 | A1 * | 11/2019 | Cavarec | E05F 15/643 |

FOREIGN PATENT DOCUMENTS

| | | | | |
|---|---|---|---|---|
| FR | 2531134 | A1 | 2/1984 | |
| FR | 2660963 | * | 10/1991 | E05F 15/652 |
| FR | 3002780 | A1 | 9/2014 | |
| WO | 2012047179 | A1 | 4/2012 | |
| WO | WO-2014139726 | A1 * | 9/2014 | E05F 15/635 |
| WO | 2015036539 | A1 | 3/2015 | |

* cited by examiner

SYSTEM FOR LOCKING A SCREEN DOOR LEAF

TECHNICAL FIELD

The disclosure relates to the field of platform screen doors. More precisely, the disclosure relates to a system for locking a screen door sliding leaf as well as to a platform screen door equipped with such a locking system.

BACKGROUND

Platform screens make it possible to separate the station platform per se from the rail track along which the platform extends, when there is no traffic on said rail track. When a train has stopped along the platform, however, the platform screen must allow users access to the carriages of the stopped train. To this end, the platform screen comprises a series of screen doors arranged so as to face the entry doors of the carriages which may stop along the platform. In a manner known per se, a platform screen door forms a module which is composed of at least one fixed panel and of an associated sliding leaf which can move between an open position and a closed position (and vice versa) along a horizontal direction in the plane of the leaf and substantially parallel to a platform edge on which the screen door is positioned. In the open position, the leaf at least partly frees an opening allowing the users to pass through, which is adjacent to the fixed panel of the screen door. In the closed position, the leaf obstructs this opening. To this end, a drive system comprising a motorization is provided between the fixed panel and the associated sliding leaf, in order to move the associated sliding leaf in its translational movements between the open and closed positions.

In general, platform screen doors comprise two fixed-panel/sliding-leaf pairs positioned mirror-symmetrically. The two fixed panels are separated from one another by a door threshold, the assembly delimiting the opening allowing the users to pass through. The two sliding leaves then have the ability to move by horizontal translational movements in the plane of the leaves, which are mutually symmetrical, between the closed position and the open position, and vice versa. Each of the sliding leaves may have an associated drive system and motorization. As an alternative, the assembly may comprise a drive system and a motorization which are common to the two associated leaves.

When there is no stopped train along the platform, the screen doors remain in the closed position. A locking system is provided so as to keep the leaves in this position regardless of the situation, so long as a train has not stopped along the platform, except when using a specific unlocking mechanism such as an opening command, a manual unlocking means, in particular a maintenance key.

Currently, locking systems operate on the principle of preventing any translation of the sliding leaves of the screen doors from the closed position. To this end, current locking systems comprise a rotating hook which acts on a cam and mechanically locks a fixed finger installed on the screen door sliding leaf to be blocked in position, and does so at the instant when the sliding leaf has reached the closed position. The rotational movement of the hook that blocks the sliding leaf in the closed position takes place under the effect of the pressure which is exerted by the finger on the lock during automatic or manual closure of the sliding leaf. Conversely, the automatic unlocking is carried out by direct activation of a lever by an electromagnet, the movement of the sliding leaf being ensured by a motor. Such a locking system is complex and requires electronic synchronization with the use of the motorization that moves the screen door sliding leaf.

BRIEF SUMMARY

The disclosure provides a system for locking a platform screen door sliding leaf which is simple and economical, and which is reliable in its operation.

To this end, the disclosure provides a system for locking a platform screen door sliding leaf, the sliding leaf being capable of moving relative to a fixed panel by a horizontal translational movement in a plane of the leaf between open and closed positions in which the leaf at least partly frees or obstructs an opening adjacent to the fixed panel, the locking system comprising:

- a bearing rail mounted fixed on the sliding leaf and comprising a reception recess;
- a motor body forming the stator of a drive motor of the sliding leaf and mounted freely in rotation about a motor axis on a gear unit;
- a locking roller mounted projecting on the motor body and arranged so as to:
  - roll along the bearing rail during a movement of the sliding leaf; and
  - engage, by a rotation of the motor body, in the reception recess when the sliding leaf reaches a given position, in order to lock it, the reception recess being arranged on the bearing rail so that this given position is the closed position or the open position.

Advantageously, but optionally, the locking system according to the disclosure has at least one of the following additional technical characteristics:

- the reception recess is arranged at one end of the bearing rail so that the given position is the closed position;
- the bearing rail comprises an additional reception recess, the two reception recesses being arranged on the bearing rail so that, in order to lock the sliding leaf, the locking roller engages, by the rotation of the motor body, in a first of the reception recesses when the sliding leaf reaches the closed position, and in a second of the reception recesses when the sliding leaf reaches the open position;
- it comprises a support for fastening the locking system according to the disclosure on a fixed panel of the screen door, relative to which the sliding leaf moves; in particular, the gear unit may be secured to the fastening support;
- the gear unit has a lateral output having a given axis; in particular, the axis of the lateral output is perpendicular to the motor axis; thus, as soon as a motor torque is applied by the motor, the motor body is driven in rotation about said motor axis, while the rotor remains stationary;
- the gear unit has an input, referred to as the input of the gear unit, for carrying out driving of the lateral output;
- the gear unit comprises a reducer making it possible to have a smaller rotation at said lateral output than at the input of the gear unit; in particular, the motor may be mounted in rotation on the reducer;
- the gear unit comprises an angle gear making it possible to transmit the drive at the input of the gear unit along the axis of the motor to said lateral output; in particular, the angle gear may be formed by the reducer;
- said lateral output comprises a drive pulley of a belt;

the motor body extends along said motor axis; in other words, this motor axis is therefore coaxial with a rotor axis of the motor;

it comprises a coupling device for mounting the motor body on the gear unit; in particular, the coupling device may be a ball bearing;

at an output of the rotor axis, the motor body comprises a ring which cooperates with said coupling device, allowing the motor body to be mounted freely in rotation on the gear unit, the rotor axis of the motor cooperating with an input of the gear unit in order to carry out driving of the lateral output;

it comprises a resilient element for restoring the locking roller into the reception recess;

it comprises a stop mounted projecting on the motor body and arranged so as to limit a rotation of the motor body during release of the locking roller from the reception recess;

the stop is separate from the locking roller; in particular, the stop may be arranged so as to be in contact with a bearing part of a fastening support of the motor, when the locking roller is released from the reception recess;

the stop may be formed by the locking roller, the stop being arranged so as to be in contact with a rolling track arranged facing said bearing rail, when the locking roller is released from the reception recess, the locking roller being arranged so as to roll both along said bearing rail and on the rolling track during a movement of the sliding leaf;

it comprises a manual unlocking mechanism;

the manual unlocking mechanism comprises:

on the one hand, a cam secured to the motor body 20, for example to the ring;

on the other hand, an inclined ramp, the manual unlocking mechanism being arranged so that a movement of the inclined ramp, in particular substantially parallel to the motor axis, allows the inclined ramp to come in contact with the cam, the cam then sliding on the inclined ramp during its movement until the locking roller is released from the reception recess;

the inclined ramp may be maneuvered by a cable, in particular one which is fixed to a finger of the inclined ramp; for example, manual pulling of the cable may move the inclined ramp, which comes in contact with the cam, and as the pulling continues, the inclination of the inclined ramp forces the body of the motor, via the cam sliding on the inclined ramp, to rotate about the motor axis until the locking roller is released from the reception recess;

the movement of the ramp continues until it comes to bear on a stop, in particular an adjustable stop, connected to the sliding leaf.

The disclosure also provides a platform screen door comprising a fixed panel and a sliding leaf capable of moving relative to the fixed panel by a horizontal translational movement in a plane of the leaf between open and closed positions in which the leaf at least partly frees or obstructs an opening adjacent to the fixed panel, as well as a system for locking the sliding leaf at least in the open position, having at least one of the characteristics above.

Advantageously, but optionally, the screen door according to the disclosure has at least one of the following additional technical characteristics:

the locking system is integrated in the screen door;

it comprises a belt drive system for driving the sliding leaf, the locking system being integrated in the motorization of the belt drive system;

said drive pulley mentioned above drives the belt driving the sliding leaf;

the belt drive system connects two sliding leaves of the screen door.

BRIEF DESCRIPTION OF THE DRAWINGS

Other characteristics and advantages of the disclosure will become apparent during the following description of an embodiment which is given purely by way of illustration. In the appended drawings.

DETAILED DESCRIPTION

Figure 1:
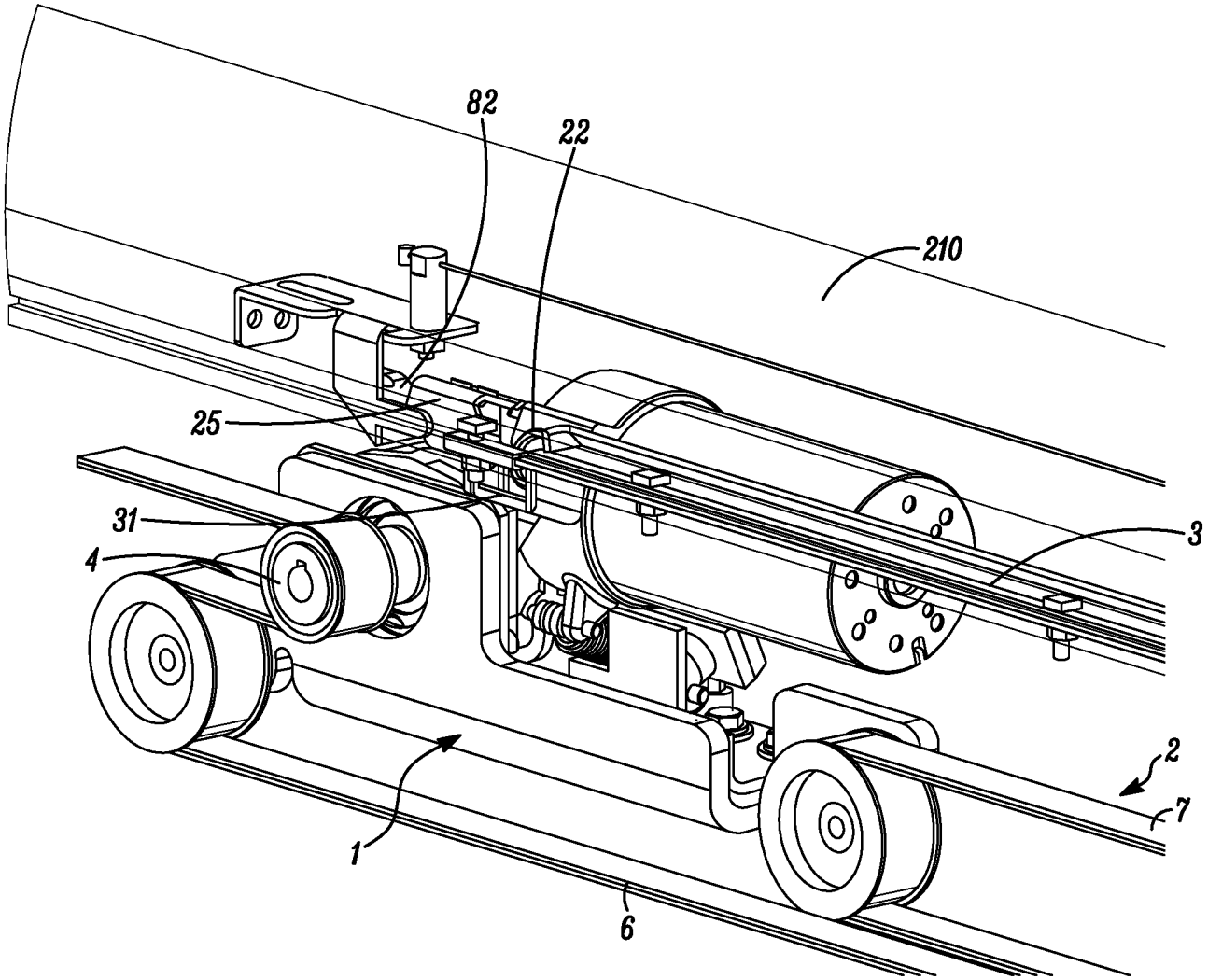
FIG. 1 is a partial three-dimensional view of a system for driving a screen door sliding leaf, comprising a locking system according to the disclosure.

In the rest of the description, we will describe a locking system 1 according to the disclosure integrated in a platform screen door comprising a belt drive system 2 for driving the sliding leaf or leaves. Such a belt drive system 2 is described in detail in Document FR3039581 or else, in a variant, in Document CN203361842, which documents may be referred to for further information. Without describing it in more detail here, referring to FIG. 1 the belt drive system 2 connects the two screen door sliding leaves 210. To this end, two belts 6 and 7 for driving the leaves 210 run below a door threshold between the two fixed panels of the screen door. A drive pulley 4, driven by a motor 12 via a gear unit 30, cooperates with the first belt 6 in order to move one of the sliding leaves 210, the other of the sliding leaves 210 being driven via the second belt 7 by one of the sliding leaves 210 in a symmetrical and synchronized fashion.

The embodiment of the locking system 1 according to the disclosure is, in this case, integrated in the motorization of the belt drive system 2. The locking system 1 according to the disclosure comprises a bearing rail 3, which is secured to the sliding leaf 210 adjacent to the motorization. At one end of the bearing rail 3, the latter comprises a reception recess 31: this reception recess 31 is positioned so that, in the closed position of the sliding leaf 210, the reception recess 31 is placed along the motor 12 (as illustrated in FIG. 1): the bearing rail 3 and the reception recess 31 follow the sliding leaf 210 in these movements between its closed and open positions.

Figure 2:
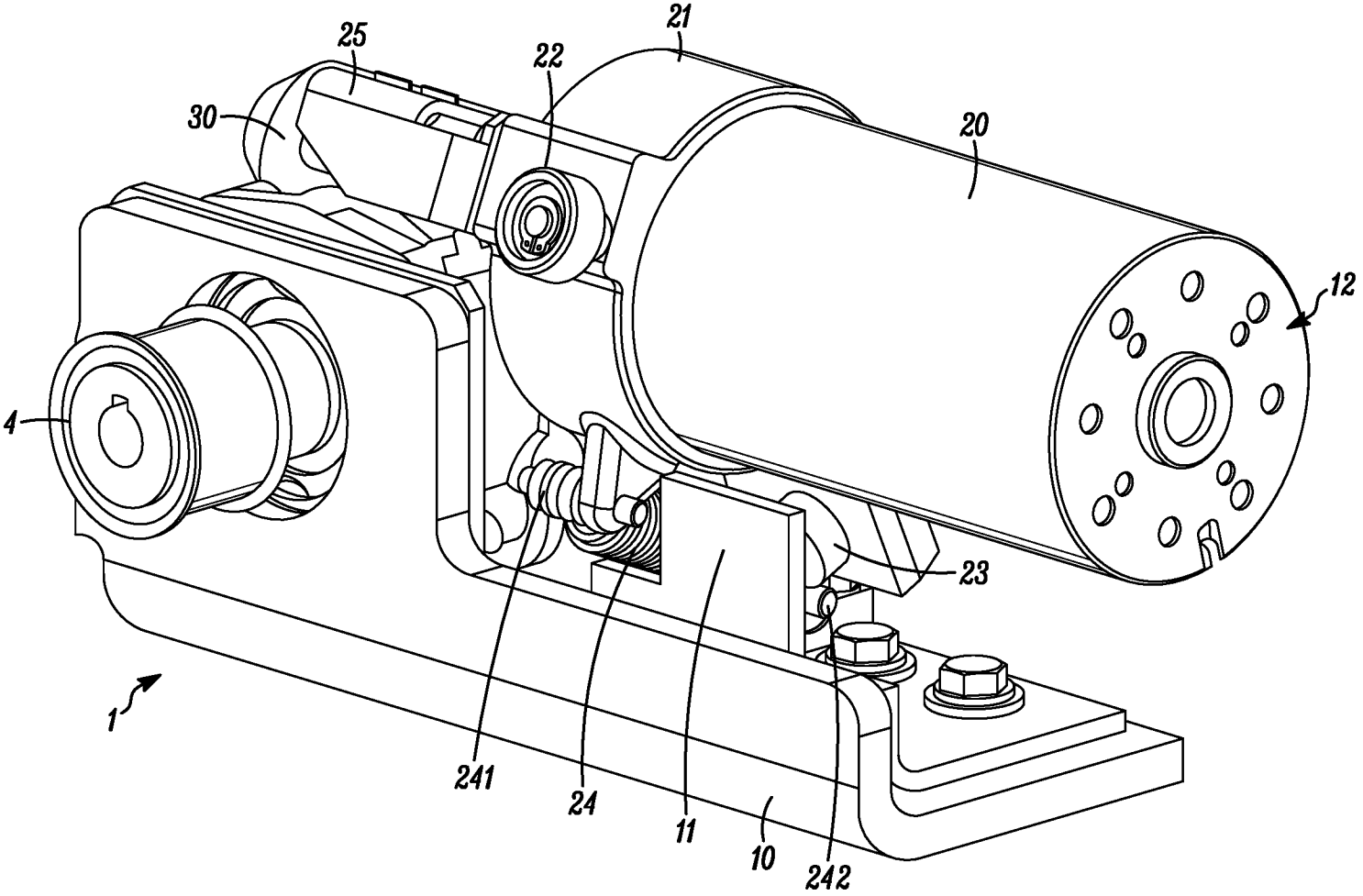
FIG. 2 is a three-dimensional view of the locking system according to the disclosure of FIG. 1.
Figure 3:
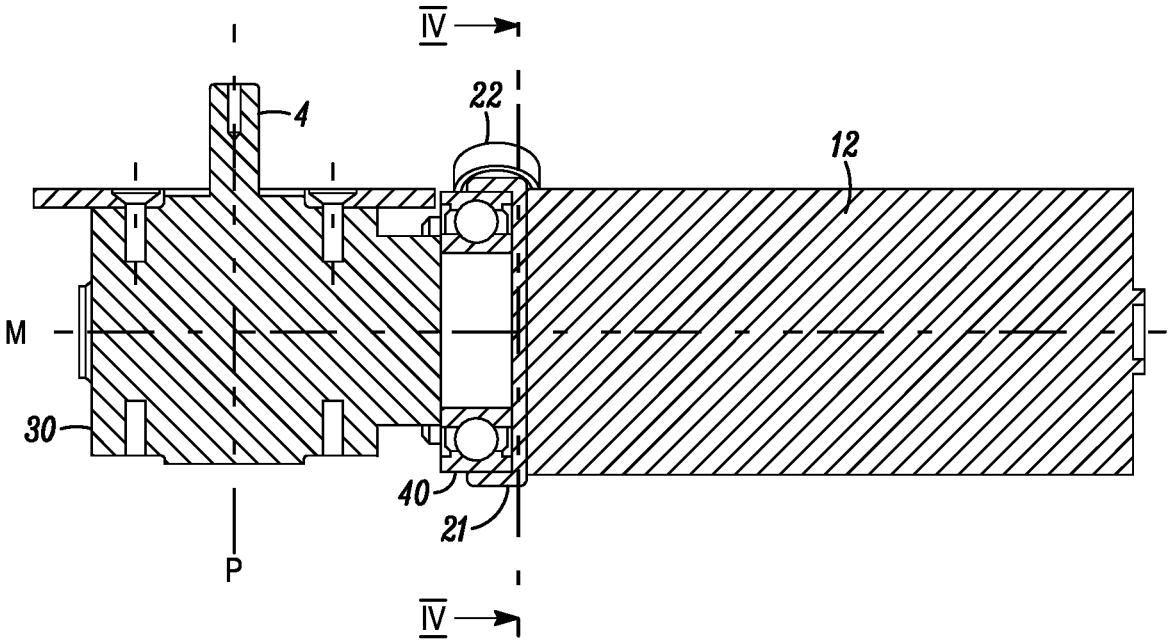
FIG. 3 is a partial view in longitudinal section of the locking system of FIG. 2.
Figure 4A:
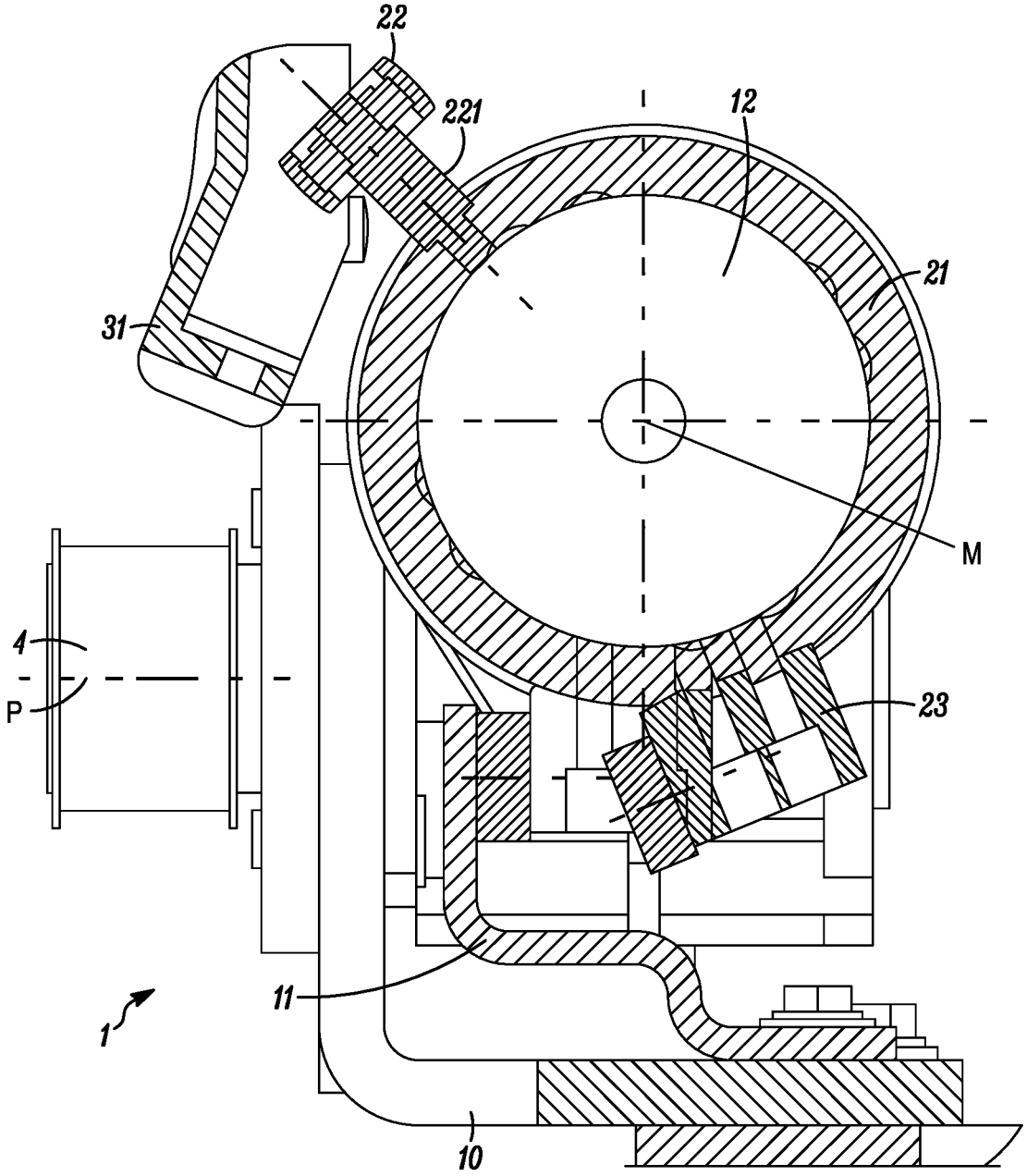
FIG. 4A is a view in section along IV-IV of the locking system of FIG. 2, showing the locking system in an open position.
Figure 4B:
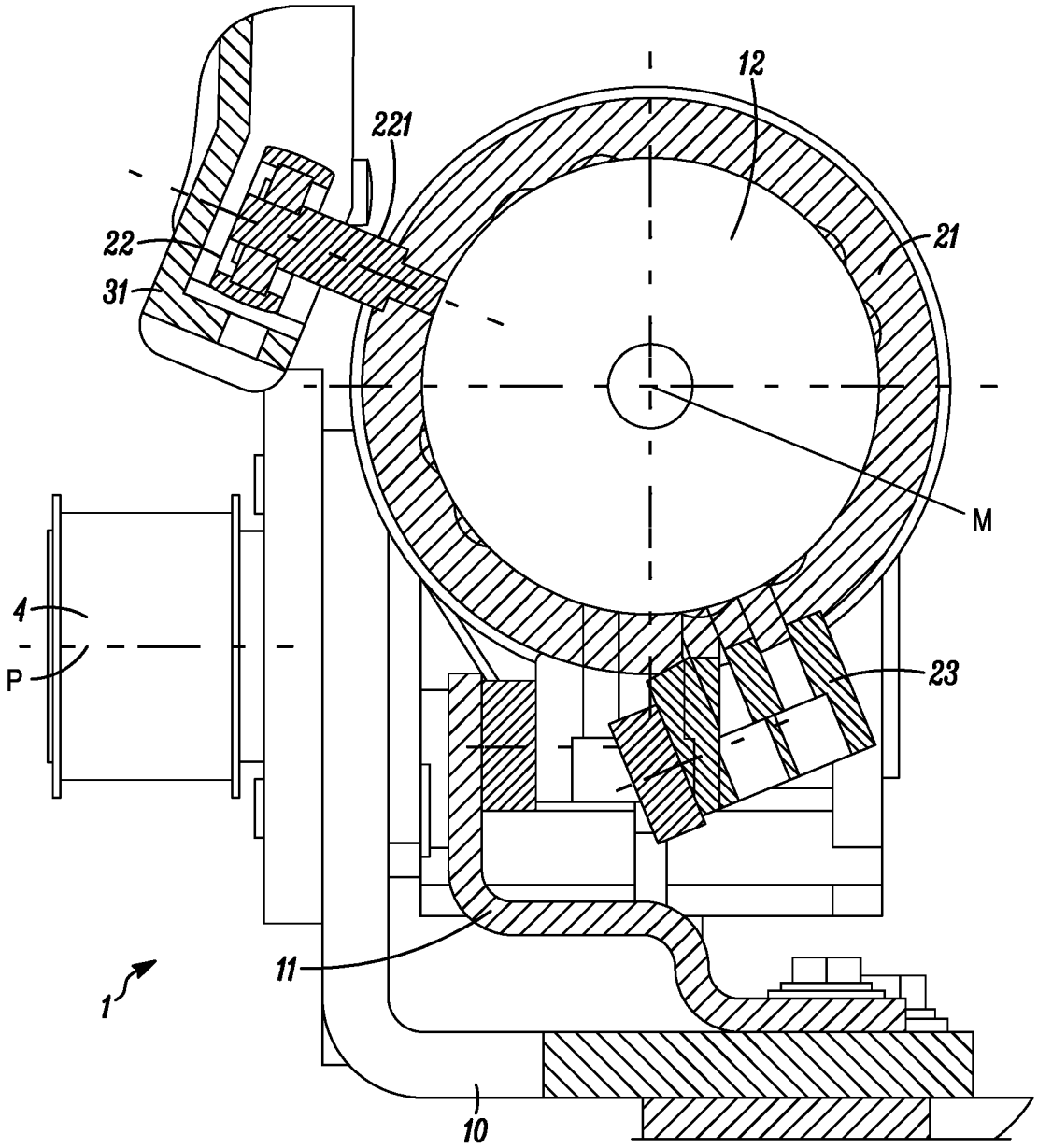
FIG. 4B is a view in section along IV-IV of the locking system of FIG. 2 showing the locking system in a closed position.
Figure 5:
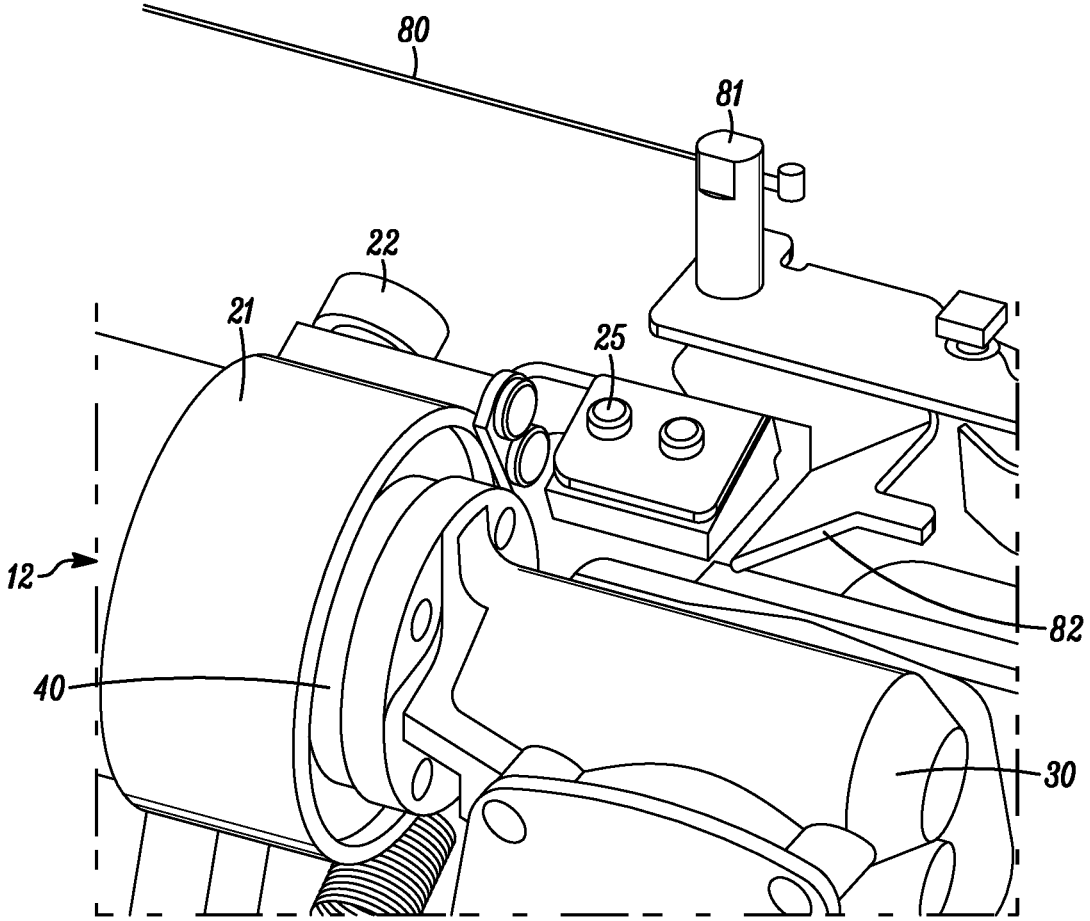
FIG. 5 is a partial three-dimensional view illustrating a manual unlocking mechanism of the locking system of FIG. 2.

Referring to FIGS. 2 to 4, the locking system 1 according to the disclosure comprises a support 10 for fastening the locking system 1 according to the disclosure on a fixed panel of the screen door relative to which the sliding leaf 210 moves. On the other hand, the locking system 1 according to the disclosure comprises a gear unit 30, of which a lateral output of axis P comprises the drive pulley 4 of the belt 6. The gear unit 30 is in this case secured to the fastening support 10. The locking system 1 according to the disclosure furthermore comprises a motor 12 having a motor body 20 forming the stator and extending along a longitudinal axis M, referred to as the "motor axis", coaxial with a rotor axis of the motor 12. At an output of the rotor axis, the motor body 20 comprises a ring 21 which cooperates with a coupling device 40, in this case a ball bearing, allowing the motor body 20 to be mounted freely in rotation on the gear unit 30, the rotor axis of the motor 12 cooperating with an input of the gear unit 30 in order to carry out driving of the lateral output P. It should be noted that the axis of the lateral output P is perpendicular to the motor axis M. Thus, as soon as a motor torque is applied by the motor 12, the motor body 20 is driven in rotation about the axis M, while the rotor remains stationary.

In a manner which is not represented, the gear unit may comprise a reducer making it possible to have a smaller rotation at said lateral output P than at the input of the gear unit 30. In particular, the motor may be mounted in rotation on the reducer.

For example, the reducer may form an angle gear making it possible to transmit the drive at the input of the gear unit 30 along the axis of the motor to said lateral output P.

In order to limit this rotation of the motor body 20 during a movement of the sliding leaf 210 from the closed position, the locking system 1 according to the disclosure comprises a stop 23 secured to the motor body 20 and extending in radial projection centrifugally from said motor body 20. The stop 23 comes to bear on a bearing part 11 of the fastening support 10. Once the stop 23 is bearing on the bearing part 11 of the fastening support 10, the motor body 20 resumes its function as a stator and the rotor of the motor 20 is set in rotational movement, driving the drive pulley 4 via the gear unit 30. In an alternative embodiment, the stop 23 is mounted in a similar way on the ring 21.

On the other hand, in order to limit the rotation of the motor body 20 during a movement of the sliding leaf 210 from the open position, the locking system 1 according to the disclosure comprises a locking roller 22 mounted at one end of an axle 221 secured to the ring 21 and extending in radial projection centrifugally from said ring 21. The locking roller 22 comes to bear on the bearing rail 3. Once the locking roller 22 is bearing on the bearing rail 3, the motor body 20 resumes its function as a stator and the rotor of the motor 20 is set in rotational movement, driving the drive pulley 4 via the gear unit 30. The sliding leaf 210 is then in translational movement from the open position to the closed position, and the locking roller 22 then rolls along on the bearing rail 3 in the direction of the reception recess 31. Once the closed position is reached by the sliding leaf 210, the locking roller 22 drops into the reception recess 31 under the effect of a residual motor torque. This locks the sliding leaf 210 in the closed position, the locking roller 22 coming to bear immediately on the sides of the reception recess 31, thus preventing any attempt at premature opening of said sliding leaf 210. In an alternative embodiment, the locking roller is mounted in a similar way on the motor body 20.

In order to ensure that the locking roller does not leave the reception recess 31, in the closed position of the sliding leaf 210, the locking system 1 according to the disclosure comprises a resilient restoring element 24, here in the form of a tension spring, acting along a direction substantially perpendicular to a radius of the ring 21 (or of the motor body 20). This resilient restoring element 24 is fixed at a first end 241 to the ring 21 (or as a variant to the motor body 20) and at a second end to the fastening support 10. This second end is not visible in FIG. 2, although it is possible to see a rod 242 which is fixed to the fastening support 10 and to which this second end is attached.

It should be noted that the relative positioning of the stop 23 and of the axle 221 carrying the locking roller 22 is such that, when the stop 23 comes to bear on the bearing part 11 of the fastening support 10, the locking roller 22 is released from the reception recess 31 then is at least in contact with the bearing rail 3, along which it can roll when the sliding leaf 210 is driven by the motor 12 from its closed position to its open position. Naturally, the motor torque making it possible to release the locking roller 22 from the reception recess 31 is greater than a restoring torque applied by the resilient restoring element 24.

Here, the stop 23 is therefore separate from the locking roller. According to an alternative embodiment which is not represented, however, the stop may be formed by the locking roller, the stop being arranged so as to be in contact with a rolling track arranged facing said bearing rail, when the locking roller is released from the recess. The locking roller is in this case arranged so as to roll both along the bearing rail and on the rolling track during the movement of the sliding leaf.

If necessary, the locking system 1 according to the disclosure comprises a manual unlocking mechanism. This mechanism comprises:

- on the one hand, a cam 25 secured to the motor body 20 or to the ring 21;
- on the other hand, an inclined ramp 82 maneuvered by a cable 80 fixed to a finger 81 of the inclined ramp 82.

Manual pulling of the cable 80 moves the inclined ramp 82, which comes in contact with the cam 25. As the pulling continues, the inclination of the inclined ramp 82 forces the body 20 of the motor, via the cam 25 sliding on the inclined ramp 82, to rotate about the axis M until at most the stop 23 comes to bear on the bearing part 11 of the fastening support 10, the locking roller 22 then being released from the reception recess 31.

It may be seen from the description above that such a structure of the locking system 1 according to the disclosure allows a significant reduction of the number of parts and simple installation, and makes it possible to avoid the use of a specific electromagnet and to use the drive motor of the sliding leaves directly controlling the locking/unlocking.

It should be noted that the bearing rail 3 may comprise an additional reception recess, which is not represented in the illustrated example but is positioned further to the right in relation to FIG. 1. The locking roller 22 engages in this additional recess when the sliding leaf 210 reaches the open position. It is then also possible to simplify blocking in the open position as well.

Naturally, numerous modifications may be made to the disclosure without thereby departing from its scope.

The invention claimed is:

1. A locking system comprising:

a bearing rail configured to be mounted on a door sliding leaf, the bearing rail including a first reception recess;

a motor body configured to form a stator of a drive motor of the door sliding leaf, the motor body configured to be rotationally mounted about a motor axis on a gear unit having a lateral output with a designated axis that is substantially perpendicular to the motor axis;

a locking roller configured to be mounted on the motor body and to roll along the bearing rail during a horizontal movement of the door sliding leaf, the locking roller also configured to enter the first reception recess responsive to the door sliding leaf reaching a designated position to lock the door sliding leaf, the first reception recess arranged on the bearing rail so that the designated position is a closed position or an open position;

a stop configured to be mounted on the motor body, the stop configured to project radially from the motor body limit a rotation of the motor body during release of the locking roller from the first reception recess; and a manual unlocking mechanism including a cam secured to the motor body and an inclined ramp, wherein the manual unlocking mechanism arranged so that movement of the inclined ramp contacts the cam, the cam configured to slide on the inclined ramp during the movement of the inclined ramp until the locking roller is released from the first reception recess.

2. The locking system of claim 1, wherein the first reception recess of the bearing rail is arranged at one end of the bearing rail so that the designated position is the closed position.

3. The locking system of claim 1, wherein the bearing rail comprises a second reception recess, the first and second reception recesses arranged on the bearing rail, wherein the locking roller enters the first reception recess while the door sliding leaf is in the closed position, and the locking roller enters the second reception recess while the door sliding leaf is in the open position.

4. The locking system of claim 1, wherein the gear unit is coupled to a fastening support.

5. The locking system of claim 1, wherein the gear unit has an input for carrying out driving of the lateral output, the gear unit including a reducer configured to have a smaller rotation at the lateral output than at the input.

6. The locking system of claim 5, wherein the motor body is rotatably mounted on the reducer.

7. The locking system of claim 1, wherein the lateral output comprises a drive pulley of a belt.

8. The locking system of claim 1, further comprising a coupling device configured to mount the motor body on the gear unit.

9. The locking system of claim 1, further comprising a resilient element configured to restore the locking roller into the first reception recess.

10. The locking system of claim 1, wherein the manual unlocking mechanism is configured to allow manual locking of the door sliding leaf.

11. The locking system of claim 1, wherein the movement of the inclined ramp is substantially parallel to the motor axis.

12. A platform screen door comprising a fixed panel and the door sliding leaf capable of moving relative to the fixed panel by a horizontal movement in a plane of the door sliding leaf between open and closed positions in which the door sliding leaf at least partly frees or obstructs an opening adjacent to the fixed panel, the platform screen door comprising a locking system for locking the door sliding leaf at least in the open position as claimed in claim 1.

13. The screen door as of claim 12, wherein the screen door comprises a belt drive system for driving the door sliding leaf, the locking system being integrated in motorization of the belt drive system.

14. The screen door as claimed in claim 13, wherein the gear unit has the lateral output having the designated axis, wherein the lateral output comprises a drive pulley of a belt, and wherein said drive pulley drives the belt driving the door sliding leaf.

15. A locking system comprising:

a door sliding leaf configured to move relative to a fixed panel by a horizontal translational movement in a plane of the sliding leaf between an open position that at least partially opens an opening adjacent the fixed panel and a closed position that at least partially frees or obstructs an opening adjacent to the fixed panel;

a bearing rail configured to be mounted on the door sliding leaf, the bearing rail including a first reception recess;

a motor body configured to form a stator of a drive motor of the door sliding leaf, the motor body rotationally mounted about a motor axis on a gear unit having a lateral output with a designated axis that is substantially perpendicular to the motor axis;

a locking roller configured to be mounted on the motor body and arranged to roll along the bearing rail during the horizontal translational movement of the door sliding leaf, the locking roller also arranged to enter the first reception recess responsive to the door sliding leaf reaching a designated position to lock the door sliding leaf, the first reception recess arranged on the bearing rail so that the designated position is the closed position or the open position;

a stop configured to be mounted on the motor body, the stop configured to project radially from the motor body and limit a rotation of the motor body during release of the locking roller from the first reception recess; and a manual unlocking mechanism including a cam secured to the motor body and an inclined ramp, wherein the manual unlocking mechanism arranged so that movement of the inclined ramp contacts the cam, the cam configured to slide on the inclined ramp during the movement of the inclined ramp until the locking roller is released from the first reception recess.

16. The locking system of claim 15, wherein the first reception recess of the bearing rail is arranged at one end of the bearing rail so that the designated position is the closed position.

17. The locking system of claim 15, wherein the bearing rail comprises a second reception recess, the first and second reception recesses arranged on the bearing rail, wherein the locking roller enters the first reception recess while the door sliding leaf is in the closed position, and the locking roller enters the second reception recess while the door sliding leaf is in the open position.

18. The locking system of claim 15, further comprising a coupling device for mounting the motor body on the gear unit.

* * * * *